United States Patent [19]

Schiller et al.

[11] Patent Number: 4,632,455

[45] Date of Patent: Dec. 30, 1986

[54] CHAIR WITH OCCUPANT ASSISTING FEATURES

[76] Inventors: Robert E. Schiller, 13616 N. 43rd St., Apt. #155, Phoenix, Ariz. 85032; Chester R. Harris, Jr., 9204 Sprague St., Omaha, Nebr. 68134

[21] Appl. No.: 714,481

[22] Filed: Mar. 21, 1985

[51] Int. Cl.[4] ..... A47C 1/02

[52] U.S. Cl. ..... 297/326; 297/183; 297/301; 297/DIG. 4; 297/DIG. 10

[58] Field of Search ..... 297/DIG. 4, 328, 347, 297/DIG. 10, 326, 411, 412, 422, 183, 355, 301, 306; 5/81 R; 280/289 WC; 248/605, 562, 596, 620

[56] References Cited

U.S. PATENT DOCUMENTS

| | | | |
|---|---|---|---|
| 1,698,344 | 1/1929 | Mott | 297/339 |
| 3,158,398 | 11/1964 | Stryker | 297/333 |
| 3,259,427 | 7/1966 | Wiest | 297/183 |
| 3,596,991 | 8/1971 | McKee | 297/286 |
| 3,679,260 | 7/1972 | Morse-Brown | 297/DIG. 10 |

FOREIGN PATENT DOCUMENTS

| | | | |
|---|---|---|---|
| 2625046 | 12/1977 | Fed. Rep. of Germany | 297/DIG. 10 |
| 8204249 | 6/1984 | Netherlands | 297/DIG. 10 |
| 8203320 | 10/1982 | PCT Int'l Appl. | 297/DIG. 10 |
| 949995 | 2/1964 | United Kingdom . | |
| 1500361 | 2/1978 | United Kingdom . | |

*Primary Examiner*—James T. McCall

*Attorney, Agent, or Firm*—E. Robert Newman

[57] ABSTRACT

A chair having a seat pivotally connected to a base frame, the seat's pivotal axis being horizontal and parallel to the front of the chair and located intermediate the front and back of the seat proximal its center of gravity. A hydraulic cylinder is attached; between the seat and base frame to dampen pivotal movement of the seat as a person is assisted into or out of the chair.

15 Claims, 3 Drawing Figures

CHAIR WITH OCCUPANT ASSISTING FEATURES

TECHNICAL FIELD

The present invention relates generally to orthopedic chairs and more particularily to chairs with occupant-assisting features.

BACKGROUND ART

Persons suffering from physical maladies often experience great difficulty getting up from a chair well as lowering themselves into a chair. For example, arthritics, and persons having back and leg ailments, cannot easily flex their knees and initiate movements towards the standing or sitting position.

The problems to which this invention addresses itself have been most commonly solved with electric recliner chairs. Having motorized power available, it is an easy thing to add what is termed an "elevating seat". In addition to being expensive, chairs employing electric motor power generally also are designed in the cushioned easy-chair style, and to the knowledge of the inventor, are available only as an adjunct to the reclining feature. Not everyone who desires a occupant-assisting chair also wishes an easy chair and not disabilities.

Other chairs which have occupant-assisting features include those which employ hydraulic rams, extending arms which the occupant pulls or pushes in order to move the seat up or down with his body, and spring assisted chairs. Such devices are generally of benefit to one requiring such assistance. However, the hydraulic approach, like its electric powered counter part is expensive and subject to breakdown. Those with pull bars are suitable only for users having adequate strength in their arms and shoulders, and the spring assisted chairs are difficult to adjust for the different sizes and weights of users.

DISCLOSURE OF INVENTION

It is a general object of the present invention to provide an improved chair with occupant-assisting features.

Another object is to provide a chair which assists a user into or out of a seated position.

A further object of the present invention is to provide a chair with occupant-assisting features which is simple in structure, and easy to maintain and operate.

Yet another object is to provide a chair with occupant-assisting features which is adjustable for persons of different weights and builds.

Another object is the provisions of a chair with occupant assisting feature which relies on the shifting of weight by the occupant for its functioning.

More generally, it is an object of the present invention to provide a chair having a seat pivotally connected to a ground-supported frame with a horizontal pivotal axis parallel to the front of the chair, said axis located intermediate the front and back of the seat at a location generally under the center of gravity of the seat. Hydraulic cylinders, which dampen the pivotal movement of the seat, are attached between the front and rear edges of the seat and the chair's frame.

These and other objects, advantages and novel features of the present invention will become apparent from the following detailed description of the invention when considered in conjunction with the accompanying drawings.

BEST MODE FOR CARRYING OUT THE INVENTION

Figure 1:
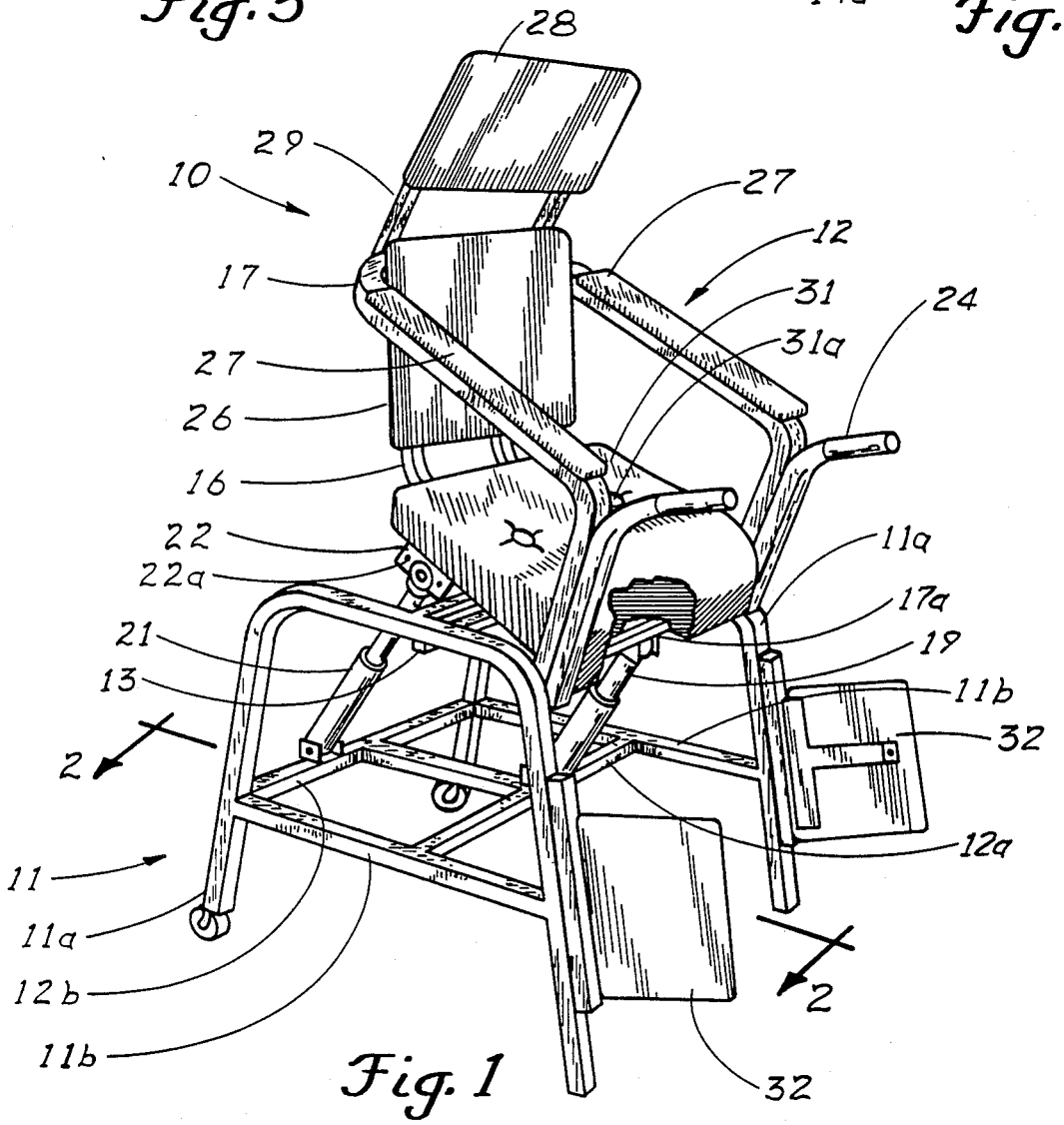
FIG. 1 is a perspective view of the present invention.

Referring now to the drawings in which identical or corresponding parts are indicated by the same reference character throughout the several views, and more particularly to FIG. 1, the chair is designated generally at 10 and has a ground-supported base frame, designated generally at 11, and a seat frame, designated generally at 12.

Figure 3:
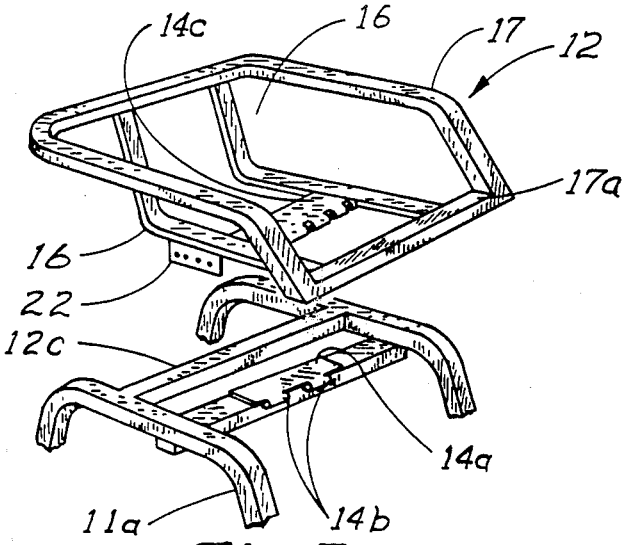
FIG. 3 is a perspective view of a portion of the invention without upholstery.
Figure 2:
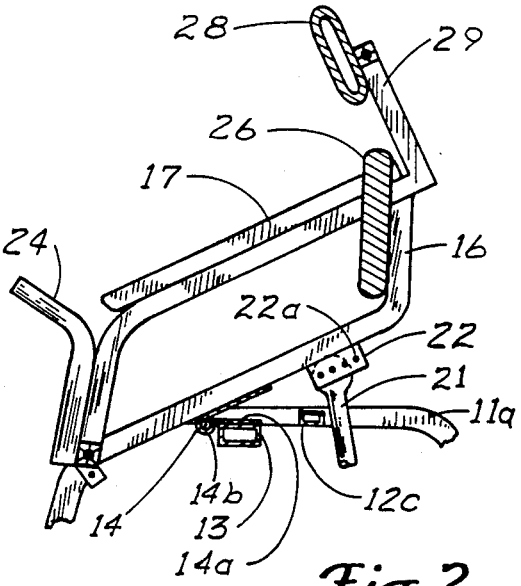
FIG. 2 is a partial cross-sectional view of the invention taken at line 2—2 in FIG. 1.

Referring now to FIGS. 1, 2, and 3, base frame 11 includes two inverted "U"-shaped leg members 11*a*, each having a cross-member 11*b* affixed between the legs thereof. "U"-shaped leg members 11*a* are connected in a spaced apart and parallel relationship via parallel connecting members 12*a*, 12*b* and 12*c*, thus forming the four legs of chair 10. Connecting member 12*a* is affixed between an intermediate point on each cross-member 11*b* such that it is perpendicular to the planes of leg members 11*a*. Connecting member 12*b* is affixed between leg members 11*a* at the juncture of cross-members 11*b* with leg members 11*a* at the rear of base frame 11. Connecting member 12*c* is affixed to the base portion, between leg members 11*a* at a point intermediate the legs, of "U"-shaped Members 11*a*. (see FIGS. 2 and 3).

As best seen in FIGS. 2 and 3, a rigid seat-supporting beam 13 is affixed between leg members 11*a* at a location proximal to, and parallel with, connecting member 12*c*. The upper surface of beam 13 is in a horizontal plane below that of the upper surface of connecting member 12*c*, the distance between the planes being equal to the thickness of a closed leaf-type hinge 14 mounted on the upper surface of beam 13. The lower leaf 14*a* of hinge 14 is affixed to the upper surface of beam 13 with its bearing portions 14*b* parallel with and just beyond the forward edge of beam 13. The upper leaf 14*c* of leaf hinge 14 is affixed to upper seat frame 12 (in a manner to be disclosed) such that seat frame 12 will pivot about the forward edge of beam 13. It can therefore be seen that connecting member 12*c* serves as a "stop," to restrain seat frame 12 from pivoting backwards beyond a normal sitting orientation.

Seat frame 12 includes a pair of "L"-shaped parallel seat support members 16 running from the front to the back. The rear-ward ends of seat supports 16 are affixed to the base portion of a "U"-shaped arm rest 17. The legs of the "U" of arm rest 17 extend downwards at the front where a front cross member 17*a* is affixed between its free ends. The forward ends of seat supports 16 are affixed to cross-members 17*a*.

The upper leaf 14*c* of leaf hinge 14 is affixed between seat supports 16 such that its bearing portions 14*b* project below seat support 16 and where it is pivotally attached to the lower leaf 14*a* of leaf hinge 14. The total width of seat frame 12 is slightly less than the distance between leg members 11*a*, so that seat frame 12 may freely pivot forwards between the front legs of chair 10.

Upper leaf 14c of leaf hinge 14 is located on seat frame 12 at a location such that the weight of seat frame 12 is roughly equal fore and aft of bearing portions 14b and 14c. Thus, only a minimal force is required to cause seat frame 12 to pivot on hinge 14. A person sitting down in, or arising from, said seat from a substantially standing position to a sitting position, or vice-versa, respectively, may do so with a minimal movement of his or her upper body backwards or forwards.

Again referring to FIG. 1, hydraulic cylinder 19 is pivotally attached at its lower end to an intermediate point on cross-member 12a of base frame 11 such that cylinder 19 will pivot within a plane parallel to each leg member 11a. Cylinder 19 is pivotally connected at its upper end to front cross-member 17a of seat frame 12. Since conventional cylinders supply a greater and more uniform bias in compression than in tension, a second cylinder 21 is pivotally affixed at its lower end to an intermediate point on cross-member 12b such that it also will pivot within a plane parallel to each leg member 11a. The upper end of cylinder 21 is pivotally connected to a plate 22 located aft of the pivot axis of seat 12 and depending from one of the seat supports 16 (see FIG. 2). Plate 22 has a series of apertues 11a punched therein so that the upper end of cylinder 21 may be removably fastened through any one of said apertures 22a.

Rear cylinder 21 will dampen rearward pivotal movement of seat frame 12 as a user seats himself therein. By refastening rear cylinder 21 within a different aperture 22a so that it is at a shallower angle, the amount of compressive bias is reduced, and a lighter weight person may be assisted into chair 10. Similarly, if cylinder 21 is fastened at a steeper angle, the compressive bias is increased to accommodate a heavier person. Cylinder 19 functions so as to dampen forward pivotal movement of seat frame 12, as the occupant leans forward to be assisted out of the chair 10.

A handgrip 24 is mounted to the forward end of each armrest 17 and extends upwardly and away from armrest 17. Handgrips 24 will allow the user to pull himself to a slightly forward leaning position in order to pivot seat frame 12, and be assisted out of chair 10. In this way, the occupant is not required to utilize his back muscles to bend forward and rise from chair 10.

An upholstered back 26 is affixed to the bent portion of seat supports 16 of seat frame 12. Upholstery is also added to the upper surfaces of armrests 17. An upholstered headrest 28 is affixed to a frame 29, which is mounted in a conventional manner upon the base portion of the "U" of armrest 17. A seat cushion 31 is mounted on seat supports 16 in a conventional manner.

Upholstery buttons 31a are installed slightly rearward from the center of seat cushion 31 to form a slight depression. The depression serves to relocate the center of gravity of an occupant in chair 10 slightly farther back than a chair with a flat cushion. This enhances the assist features described hereinabove, since seat frame 12 will more easily pivot rearwardly with the added force applied to the rear portion of seat frame 12 by this relocation of center of gravity.

Conventional foot rests 32, of the type which may be pivoted between a vertical (as shown) and horizontal position, may be added to the front legs of chair 10, as required by the particular user.

It will be readily understood that the particular disposition or arrangement or nature of the elements of the invention are not of the essence of the invention, and that many variations, substitutions, and modifications may be made in, the departure from the particular construction and characterization in the drawings and foregoing description, without departing from the true spirit of the invention. It is therefoe to be understood that the invention should be limited only by the breath and scope of the appended claims.

What is claimed is:

1. A chair with occupant-assisting feature, comprising:

a ground-supported frame having a transversely-oriented beam affixed thereto intermediate the front and back of said frame at seat level;

a seat affixed to said beam for pivotal movement about the longitudinal axis thereof;

wherein said frame is open in front to allow said seat to pivot frontwards to a nearly vertical orientation and has means for restricting its backwards pivot to a sitting orientation; and wherein the location on said seat where it is affixed to said beam is such that its weight fore and aft of said location will enable a person sitting down in, or arising from, said seat to do so from a substantially standing position to a sitting position, or vice-versa, respectively, by a minimal movement of his or her upper body backwards or forwards, respectively.

2. The chair of claim 1, further comprising means for dampening pivotal movement of said seat.

3. The chair of claim 1, further comprising a back element rigidly mounted to said seat.

4. The chair of claim 1, further comprising armrests rigidly mounted to said seat.

5. The chair of claim 1, further comprising handgrips rigidly mounted to said seat and extending upwardly and outwardly from the two front corners thereof.

6. The chair of claim 2, wherein said dampening means includes a first hydraulic cylinder pivotally attached between said frame and said seat at a point fore of the pivotal axis of said seat and a second hydraulic cylinder pivotally attached below said frame and said seat at a point aft thereof, whereby said cylinders will bias against pivotal movement in both directions.

7. The chair of claim 3, further comprising a head rest rigidly mounted to said back element and extending generally vertically therefrom.

8. The chair of claim 6, wherein the pivotal attachment of one end of said cylinder includes a plurality of attachment positions oriented such that the length of said cylinder may be adjusted by selective attachment to a different attachment position, whereby the amount of bias of said cylinder may be adjusted for the weight of a particular user.

9. The chair of claim 2, further comprising handgrips rigidly mounted to said seat and extending upwardly and outwardly from the two front corners thereof.

10. The chair of claim 3, further comprising handgrips rigidly mounted to said seat and extending upwardly and outwardly from the two front corners thereof.

11. The chair of claim 4, further comprising handgrips rigidly mounted to said seat and extending upwardly and outwardly from the two front corners thereof.

12. The chair of claim 2, further comprising a back element rigidly mounted to said seat.

13. The chair of claim 2, further comprising armrests rigidly mounted to said seat.

14. The chair of claim 12, further comprising handgrips rigidly mounted to said seat and extending upwardly and outwardly from the two front corners thereof.

15. The chair of claim 13, further comprising handgrips rigidly mounted to said seat and extending upwardly and outwardly from two front corners thereof.

* * * * *